United States Patent [19]

Arinci et al.

[11] 4,218,804

[45] Aug. 26, 1980

[54] CLEANING BROOM OF IMPROVED STRUCTURE

[76] Inventors: Giovanni Arinci, Via Cecinese, 56, Larciano Province of Pistoia; Mauro Buscioni, Via Peloni, 18, Montecatini Terme Province of Pistoia, both of Italy

[21] Appl. No.: 452

[22] Filed: Jan. 2, 1979

[30] Foreign Application Priority Data

May 4, 1978 [IT] Italy ..... 45510 A/78

[51] Int. Cl.[2] ..... A46B 3/08

[52] U.S. Cl. ..... 15/174; 15/177; 15/205

[58] Field of Search ..... 15/171, 173, 174, 175, 15/195, 199, 205, 229, 177

[56] References Cited

U.S. PATENT DOCUMENTS

| | | | |
|---|---|---|---|
| 1,131,012 | 3/1915 | Speese | 15/173 X |
| 2,070,169 | 2/1937 | Lodge | 15/177 X |
| 2,826,777 | 3/1958 | Le Febvre | 15/205 |
| 3,032,796 | 5/1962 | Le Febvre et al. | 15/205 |

*Primary Examiner*—Edward L. Roberts

*Attorney, Agent, or Firm*—Guido Modiano; Albert Josif

[57] ABSTRACT

A cleaning broom comprises a layer of bristles provided with a plurality of slots extending along the main sides of the broom, a supporting core in the inside of the layer of bristles, a ring wrapped round the core and layer and provided with slots corresponding to those in the core, and a pair of strips disposed on the ring and provided with transversely extending lugs. Each lug traverses the slots in the core and in a portion of the ring and nails are inserted into the core to rigidly connect the strips to the core.

8 Claims, 8 Drawing Figures

CLEANING BROOM OF IMPROVED STRUCTURE

BACKGROUND OF THE INVENTION

This invention relates to a cleaning broom of improved structure.

Brooms in which the working head is formed from vegetable or synthetic fibres notably comprise, in addition to the fibres, a core or support for the fibres and a handle connected to this support.

The support can be suitable for supporting fibres formed either from single bristles or from double bristles, i.e. bristles bent double. In addition, the support can be of varying structure, and can require very different methods for fixing the fibres and handle. The large variety of these methods, which themselves govern the quality of contruction and the cost of a broom of the said type, is understandable when it is considered that brooms are very widely used in all countries.

A list is given hereinafter of the main methods known to the applicants for contructing brooms.

1. Providing a support (of wood or plastics) with a certain number of fairly close bores, into each of which is inserted the end of a bunch of bristles, as in the case of the fixing for a brush.

2. Inserting the head of a layer of bristles into a support provided upperly with a bore for the handle. Adhesive resin is injected through the bore in order to join the bristles and support together into a single body.

3. Inserting a layer of bristles between the electrodes of a welder (resistance, ultrasonic etc.) to weld together the heads of the bristles. The welded region is inserted with sufficient tightness into a cap containing the bore for the handle.

4. Arranging a bristle layer of constant thickness around a support known as a core, which is covered by the bristles and is of an easily perforable type, or around an easily penetrated padding. The layer is supported by a ring fixed by nails which pass into the core and are bent over so as to lock and compress the assembly. A lower ring with bent metal claws is also usually provided to make the bristle layer even more compact.

5. Inserting a layer of bristles, bent double on a core, into a plastics cap and fixing it to the cap by two metal claws which pass through and are bent over on the other side so as to compress the assembly.

6. Butt-positioning of a layer of bristles around a core which preferably comprises three bores, and fixing the layer by a metal ring also possessing three opposing bores which correspond to those in the core, and using three rivets to compress the assembly. The central rivet is sometimes usefully replaced by a bolt which can also fix the cap with the bore for the handle.

The listed methods have considerable limits and deficiencies. The basic defect is the fact that craftsman-type methods are used in construction, because of which production is low and cost is high due to the considerable labour content. In this sense, the application of nails, claws, rivets, screws, stitching etc. by hand (or by elementary equipment or non-automatic machines) is very uneconomical.

In particular, stitching between the bristles is a cause of serious drawbacks because it requires the use of semi-automatic machines of low production, and because increasing stitching difficulties arise as the broom length increases. Finally, the bristles inevitably become slack after a short time, leading to a rapid deterioration of the broom.

The injection of adhesive resin (method 2) and the welding between resin bristles and the cap (method 3) are also carried out on a craftsmanship scale. Brooms constructed up to the present time have one common defect, namely the fact that their assembly, which is initially sufficiently stable, becomes very slack in a short time because during use it is necessary to frequently subject the broom to large impacts in order to remove foreign bodies embedded in or adhering to the bristles.

SUMMARY OF THE INVENTION

Given this situation, the general object of the present invention is to obviate the aforesaid drawbacks by providing a broom structure which is improved in the sense of making it resistant (in particular indeformable in the long run) and, at the same time, economical, and constructable with automatic machines.

A further object is to provide an improved structure which is versatile, i.e. able to use bristles of synthetic fibres or vegetable fibres, which are either doubled or single.

These objects are attained by a cleaning broom of improved structure, including a layer of bristles, a support for said layer and a support handle, characterized in that said support comprises an elongated core internal to the layer of bristles and provided with a plurality of transverse slots extending along said core, a ring arranged to wrap round said core and said layer, and provided with slots corresponding to those in said core, a pair of strips disposed on said ring and provided with lugs transversely to the strips, said two strips being mounted opposite to each other on the elongated sides of said core, each of said lugs traversing said slots in said core and in a portion of said ring, nails being inserted into said core in a direction orthogonal to said lugs so as to rigidly connect said strips to the core.

BRIEF DESCRIPTION OF THE DRAWING

Further characteristics and advantages will be more apparent from the description of a preferred but not exclusive embodiment of the invention, illustrated by way of example in the accompanying drawings in which.

DESCRIPTION OF THE PREFERRED EMBODIMENT

Figure 1:
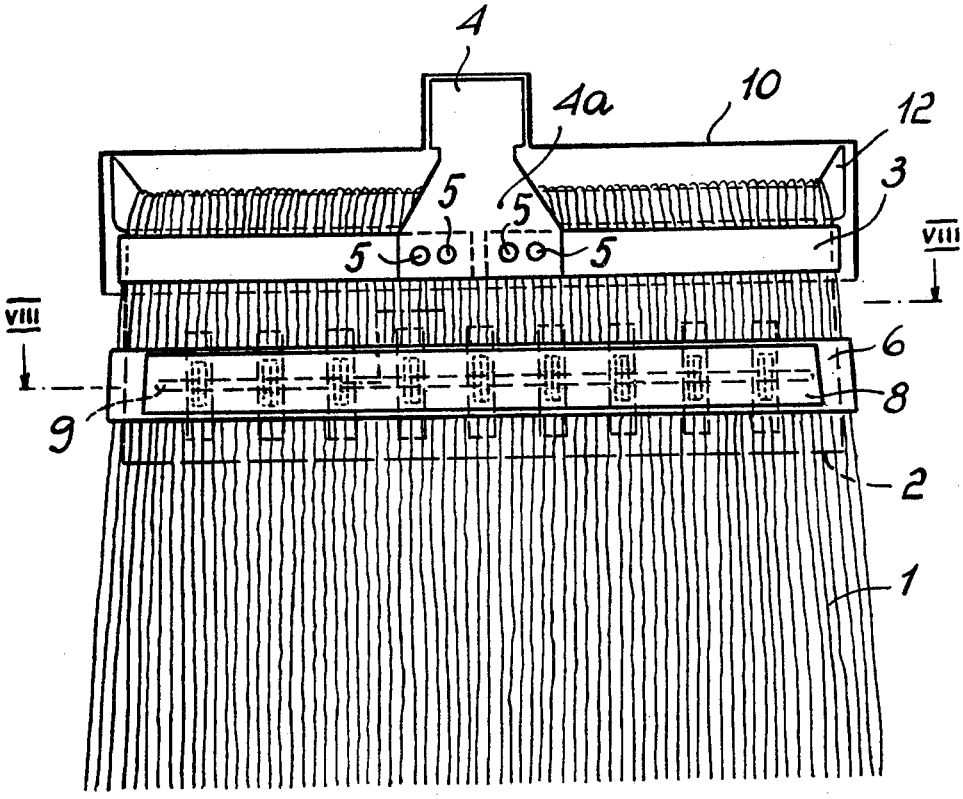
FIG. 1 is a partly sectional view of the broom structure, without the handle.
Figure 8:
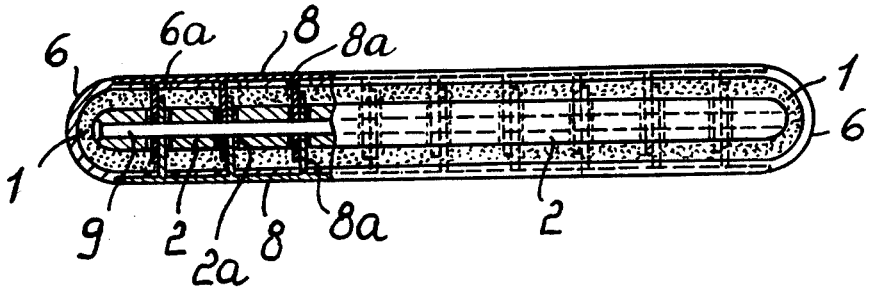
FIG. 8 is a section through the assembled broom on the line VIII—VIII of FIG. 1.
Figure 2:
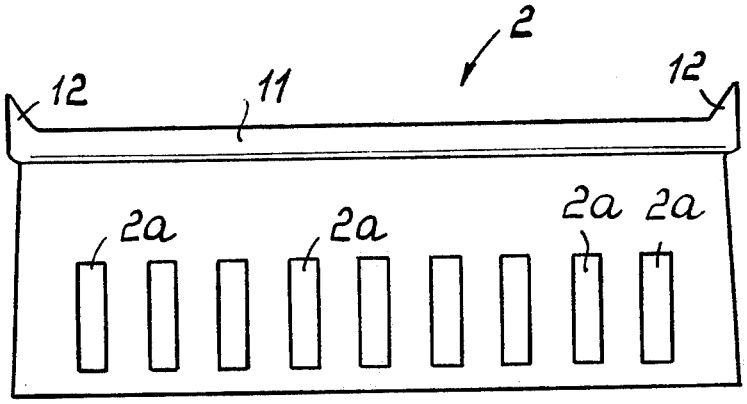
FIGS. 2 and 3 are a front and side view respectively of the support or core structure which supports the broom fibres or bristles from inside.
Figure 3:
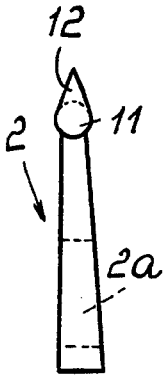

The details of the invention will be illustrated briefly hereinafter with regard to the said figures, with reference for simplicity to synthetic fibre bristles 1 doubled on a support or core 2, without however wishing to exclude vegetable or synthetic fibre bristles which are not doubled on the support or core, these also being suitable for use as will be apparent from the following description.

The core or support 2, preferably but not exclusively of plastics, advantageously comprises a certain number of slots 2*a* for the insertion of lugs 8*a* of two opposing strips 8. It also comprises an upper enlargement 11 to ensure stable positioning of a band 3, and two projecting ends 12 to keep the upper length of the bristle layer constant. In the case of bristles not doubled, the two ends can be dispensed with.

Said band 3 is preferably but not exclusively of resilient steel.

A tube 4 is provided for inserting a handle, and comprises two flat opposing flanges 4*a* which are bayonet-mounted and extend to cover the band 3, and in particular the two ends of the band, which is mounted open. The tube 4 can be of cylindrical or conical shape, and can be locked to the handle by pressure points, by nails (fixed handle) or by a thread (interchangeable handle).

Electric welding spots 5 are provided to enable said flat flanges 4*a* to be simultaneously connected to said band 3 by compression on an automatic machine.

Figure 4:
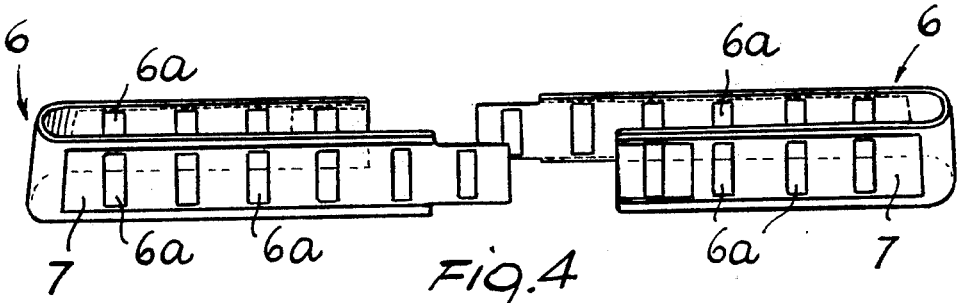
FIG. 4 shows a ring divided into two half rings and wrapped round the fibres.
Figure 5:
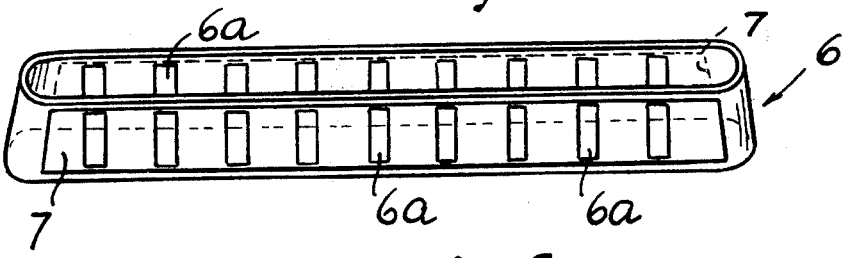
FIG. 5 shows the same ring in a single piece.

The bristles 1 are wrapped by a ring 6 (FIG. 5) which is preferably, but not exclusively, of plastics and is provided with slots 6*a* corresponding to the slots in the core 2, and with continuous front and rear grooves 7 for housing said lugged strips 8. The ring 6 can either be in one piece or formed from half rings (FIG. 4) connected together (by butting or by overlapping).

Figure 6:
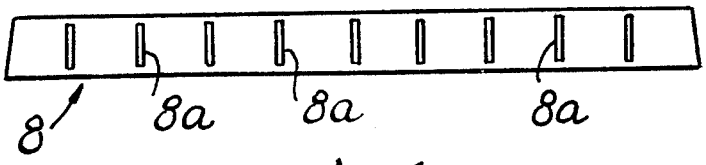
FIGS. 6 and 7 are front and side views of a strip comprising lugs for insertion into said ring of FIGS. 4 and 5.
Figure 7:
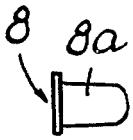

Said two flat strips 8 are preferably but not exclusively of plastics material, and as stated are provided with lugs 8*a* perpendicular to the strips 8. The lugs are provided for insertion into the front and rear grooves 7 of the ring (FIG. 6).

Very strong metal nails 9 are then inserted under pressure orthogonally to the lugs 8*a*. The nails can be of any number, diameter and length.

Finally, a cap 10, preferably but not exclusively of plastics, is provided for covering the upper region of the broom.

The described members have the following function.

In the support or core 2, the two projecting ends 12 are provided to keep the upper width of the broom constant (with bristles not doubled, the two ends can be dispensed with), and the slots 2*a* are provided to obtain a good connection with the layer of bristles 1 and consequently with the other introduced members in that, according to the invention, the purpose of the core is not only to constitute a more or less resistant body (i.e. a spacer), but also to constitute a member which directly cooperates in anchoring the bristles, together with the band 3 mounted as a ring, and adequately compressed on the layer of bristles 1, and with the ring 6 locked by the strips 8 and nails 9.

As stated, the flat flanges 4*a* of the tube 4 for the handle, which are bayonet-mounted in the upper central region of the broom, have a length such as to cover the metal band 3, and in particular the two ends of the band, so that the tube 4 serves both to lock the handle and to rigidly join together the two ends of the band 3 by electrical spot welds, at the same time exerting compression on the band 3 and flanges 4*a* to make the assembly particularly compact and indeformable.

The bristles are also anchored by the ring 6 positioned in the central region of the broom and provided with a certain number of slots 6*a*, corresponding to those in the core 2, and in which the lugs 8*a* of the strips 8 are inserted. The number of lugs is equal to the number of slots 2*a* in the core 2.

The two flat strips 8 are inserted into the two opposing grooves 7 in the ring 6, so that the respective lugs 8*a* become freely inserted into the slots 2*a* in the core 2.

The nails 9 are inserted under pressure in a direction orthogonal to the lugs 8*a*, so that they perforate the lugs and produce a rigid and indeformable assembly.

Finally, the cap 10 covers the entire upper region of the broom, for protection and appearance purposes.

The invention attains the proposed objects. In this respect, the support or core 2 not only provides a more or less resistant spacer, but also considerably increases the strength and indeformability of the broom because of its slots 2*a* into which the lugs 8*a* are inserted, and because of the locking by means of the nails 9. In the assembly, the function previously performed in an unsatisfactory manner by the stitching is now satisfactorily performed.

Finally, the core 2 according to the invention also enables vegetable or artificial fibre bristles which are not doubled over, to be used without any difficulty.

Moreover, all the members are provided for automatic assembly and are very simply and easily obtainable. Thus the cost of the manufactured article is extremely advantageous, also because the labour content is minimal.

The invention also has the following advantages:

(a) Absolute indeformability of the assembly, even after prolonged use and after a large number of impacts.

(b) The macroscopic corrosion of the metal members and the spot welds by the action of liquid and atmospheric agents (leading to the possible separation of the members) is certain not to occur until after the macroscopic wear of the bristles.

(c) The compression action exerted by the automatic machine on assembly is such as not to damage the bristles or other members in any way.

The invention as conceived is susceptible to numerous modifications, all of which fall within the scope of the inventive idea. Furthermore, all details can be replaced by technically equivalent members. In practice, any materials and dimensions can be used according to requirements.

We claim:

1. A cleaning broom of improved structure including a layer of bristles, a support for said layer and a support handle, characterized in that said support comprises an elongated core internal to the layer of bristles and provided with a plurality of transverse slots extending along said core, a ring arranged to wrap round said core and said layer, and provided with slots corresponding to those in said core, a pair of strips disposed on said ring and provided with lugs transversely to the strips, said two strips being mounted opposite to each other on the elongated sides of said core, each of said lugs traversing said slots in said core and in a portion of said ring, nails being inserted into said core in a direction orthogonal to said lugs so as to rigidly connect said strips to the core.

2. A broom as claimed in claim 1, wherein said strips are inserted and positioned in grooves provided in said ring.

3. A broom as claimed in claim 2, wherein a band arranged to clamp the layer of bristles on to the core is inserted between said ring and the upper end of said core.

4. A broom as claimed in claim 3, wherein said band has adjacent ends and a tube for receiving a handle is fixed to said band, said tube being fixed by flat flanges projecting therefrom to such an extent as to make contact with the ends of said band.

5. A broom as claimed in claim 4, wherein said band is endlessly closed by electric spot welds which at the same time connect said flanges to said band.

6. A broom as claimed in claim 3, wherein said band is disposed immediately adjacent to an enlargement in said core which defines the upper end of the core, closest to the handle.

7. A broom as claimed in claim 6, wherein two projecting ends are provided at the sides of said enlargement to keep the upper length of the layer of bristles constant, when said bristles are bent over said core.

8. A broom as claimed in claim 1, wherein the upper portion of said broom is covered by a plastics cap which upperly surrounds said tube.

* * * * *